US006886385B2

(12) United States Patent
Lottner

(10) Patent No.: US 6,886,385 B2
(45) Date of Patent: May 3, 2005

(54) METHOD OF CONTINUOUS PRODUCTION OF METAL WIRES

(75) Inventor: Günter Lottner, Neunburg (DE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 10/638,530

(22) Filed: Aug. 12, 2003

(65) Prior Publication Data

US 2004/0055352 A1 Mar. 25, 2004

(30) Foreign Application Priority Data

Aug. 13, 2002 (DE) ..... 102 37 027

(51) Int. Cl.[7] ..... B21C 1/04
(52) U.S. Cl. ..... 72/278
(58) Field of Search ..... 72/278, 274, 282, 72/468

(56) References Cited

U.S. PATENT DOCUMENTS 1,355,745 A * 10/1920 Howarth ..... 72/468
2,152,842 A * 4/1939 Evans ..... 72/47
2,286,759 A * 6/1942 Patnode ..... 72/46
3,184,943 A * 5/1965 Ware ..... 72/206
3,343,395 A * 9/1967 Lagermasini et al. ..... 72/206
3,375,692 A * 4/1968 Ware ..... 72/206
3,628,449 A * 12/1971 Phillips, Jr. ..... 72/468
3,645,123 A * 2/1972 Auge ..... 72/286
3,680,348 A 8/1972 Nino et al.
3,811,311 A * 5/1974 Barone et al. ..... 72/278
4,549,420 A 10/1985 Cloostermans-Huwaert
4,820,896 A * 4/1989 Weil et al. ..... 219/83

FOREIGN PATENT DOCUMENTS

DE 612622 4/1935
DE 26 28 285 A1 1/1977
DE 101 52 054 A1 4/2003

* cited by examiner

*Primary Examiner*—Daniel C. Crane
(74) *Attorney, Agent, or Firm*—Sughrue Mion, PLLC

(57) ABSTRACT

In a method for continuous production of metal wires, the cross section of a round metal wire is reduced in one or more stages. To do so, the metal wire is shaped in a bore that is open on one side to form a flat wire at least in the last stage.

9 Claims, 1 Drawing Sheet

METHOD OF CONTINUOUS PRODUCTION OF METAL WIRES

This application is based on and claims the benefit of German Patent Application No. 10237027.3 filed Aug. 13, 2002, which is incorporated by reference herein.

BACKGROUND OF THE INVENTION

This invention relates to a method of continuous production of metal wires, whereby the cross section of a round metal wire is reduced in one or more stages, as well as a device for implementing such a method.

In the industry, in particular in the electronics industry, there is a great demand for flat metal wires. A flat wire is generally understood to mean a wire having a rectangular cross section with a much smaller thickness in relation to its width.

Production of such flat wires is performed by rolling round wires in the traditional manner. The starting material is usually Properzi wires, which can be manufactured inexpensively by the continuous casting and rolling method.

The round wires are first drawn down on a multiple drawing machine and are then shaped to form the flat wire in a downstream rolling operation.

The disadvantage of this procedure is that the rolling is relatively slow because of the high heat evolved. In addition, the rolling operation is quite maintenance intensive.

SUMMARY OF THE INVENTION

The object of the present invention is to provide a method with which flat wires can be produced economically from round wires in one operation.

This object is achieved by shaping the metal wire in a bore that is open at the side to form a flat wire.

The essential advantage of this invention can be seen in the fact that the working stage of "flattening" is integrated into the drawing operation, which is performed at a high speed. This does not produce a flat wire with an exactly rectangular cross section, but instead it yields a wire having a cross section in which the long sides are parallel to one another and the narrow sides are rounded.

The flat wires that can be produced according to the teaching of this invention are preferably used as shielding wires for electric cables and lines. At the same metal weight, they are capable of covering a larger area and thus lead to considerable savings in terms of the weight and cost of the cables and lines.

The flat wires can be processed to a braid in braiding installations, in particular if the ratio of the thickness to the width of the flat wires amounts to less than 1:5.

In addition to the possibility of performing the shaping of the round wire to a flat wire in the same operation as the drawing of the round wire more or less as the last step, there is also the possibility of shaping the round wire to form a flat wire following the drawing operation as part of the process of rewinding the wire from one spool to another.

Other advantageous embodiments of this invention are realized by the particular method and device described herein.

BRIEF DESCRIPTION OF THE DRAWINGS

This invention is explained in greater detail on the basis of the exemplary embodiments diagramed schematically in FIGS. 1 and 2.

DETAILED DESCRIPTION OF THE INVENTION

Figure 1:
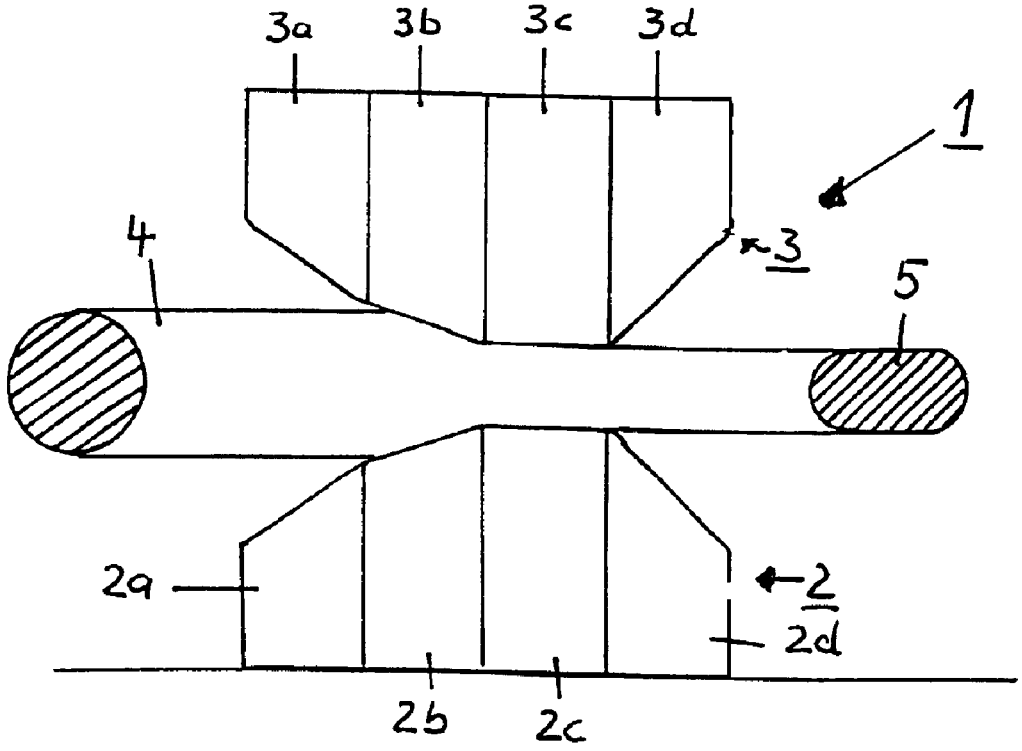

FIG. 1 shows a side view of a drawing die 1 composed of a bottom part 2 and a top part 3. The bottom part 2 is preferably arranged in a fixed position on a substrate. The top part 3 is also fixed in its position in relation to the bottom part 2, but the distance from the bottom part 2 to the top part 3 is adjustable.

The bottom part 2 and the top part 3 each have an inlet area 2*a* and 3*a*, thus providing cooling for the die 1. As seen in the direction of production (from left to right in the figure), there then follow the shaping area 2*b* and 3*b* and the calibration area 2*c* and 3*c*, which determine the thickness of the flat wire. The outlet area is labeled as 2*d* and 3*d*.

As shown in FIG. 1, in a drawing operation, the round wire 4 is gradually shaped to yield a flat wire 5 by the die 1, which consists of the bottom part 2 and the top part 3. Due to the fact that the die 1 is open toward the sides, the cross section of the flat wire is not rectangular, but instead the narrow sides are curved, which results in the shaping being a flattening or a squeezing operation in the actual sense.

Figure 2:
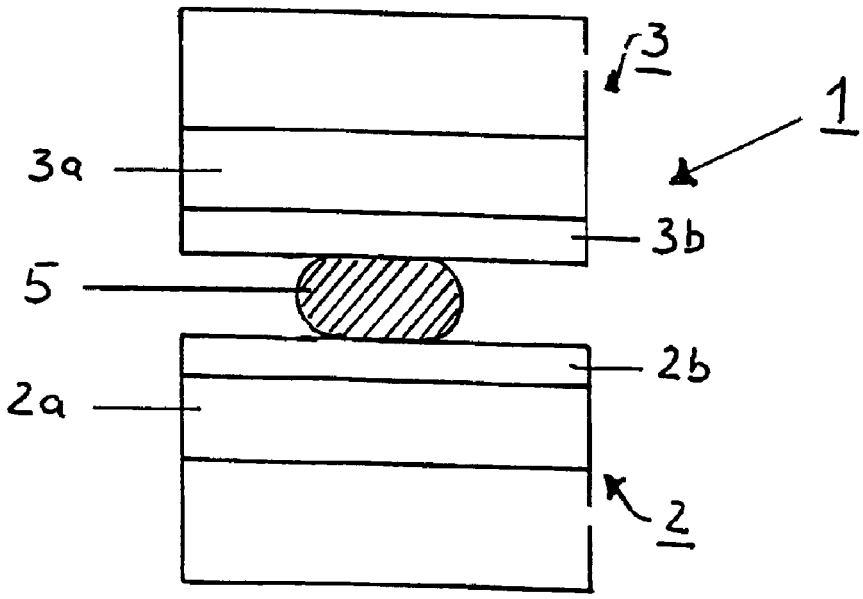

FIG. 2 shows a view of the die 1 in the direction opposite the manufacturing direction. It is clearly discernible here that the die 1 does not have a closed bore.

To present lateral displacement of the round wire 4 and/or the flat wire 5, guides (not shown) may be provided in front of and/or behind the die 1.

The die 1 shown in FIGS. 1 and 2 may be used as the last drawing stage in a continuous multiple drawing machine, in which case a plurality of dies according to this invention may also be arranged in succession to permit gradual shaping to yield the final cross section of the flat wire 5. This shaping may be associated with a reduction in cross section, but the cross sections of the round wire and the flat wire may also be of the same order of magnitude.

The die according to this invention may also be used in rewinding wire from a first spool to a second spool, in which case the round wire being drawn off the first spool is shaped to form the flat wire, which is then wound onto the second spool.

In addition to the advantages mentioned above, this invention also has the decisive advantage that the surfaces of the bottom part 2 and the top part 3, which are necessary for the shaping, can be polished much more easily than is the case with dies having a closed bore.

What is claimed is:

1. A method of continuous production of metal wires, whereby the cross section of a bare metal wire is reduced in several stages, wherein the last stage, the bare wire is shaped to form a flat wire by drawing the bare wire through a drawing die, the bore of which is open at the side and which is composed of a bottom part (2) and a top part (3) and the distance from the top part (3) to the bottom part (2) is adjustable and wherein the shaping to form the flat wire is performed without any significant reduction in cross section.

2. The method according to claim 1, wherein the round metal wire is shaped to a flat wire having a maximum ratio of thickness to width of 1:5.

3. method according to claim 1, wherein the round metal wire is shaped to form the flat wire in up to five shaping steps.

4. A device for implementing the method of claim 1, said device comprising a run-off device for the round metal wire, a plurality of dies arranged one after the other and a draw-off disk, which is provided downstream from each die and has an adjustable drive, wherein at least the last die is composed of a bottom part (2) and a top part (3), and the distance from the top part (3) to the bottom part (2) is adjustable.

5. The device according to claim 4, wherein the bottom part (2) is arranged in a fixed position and the top part (3) is adjustable in height.

6. The device according to claim 5, wherein the bottom part (2) and the top part (3) comprise elongated components whose facing surfaces have a first area (2*a*, 3*a*) which tapers in the direction of production and has an approach angle of more than 25°, a second area (2*b*, 3*b*) which tapers in the direction of production and has an approach angle between 1.5° and 20°, a third area (2*c*, 3*c*) where the surface of the bottom part (2) and the top part (3) run almost parallel to one another, and a fourth area (2*d*, 3*d*) which becomes wider in the direction of production, whereby the first area (2*a*, 3*a*) is used for cooling the bottom part (2) and the top part (3), the second area (2*b*, 3*b*) is used for shaping and the third area (2*c*, 3*c*) determines the wall thickness of the flattened wire (5).

7. The device according to claim 4, wherein the facing surfaces of the bottom part (2) and the top part (3) are provided at least partially with an abrasion-resistant coating.

8. The device according to claim 7, wherein the coating is a diamond coating.

9. The device according to claim 7, wherein the layer is a super-hard amorphous carbon layer.

* * * * *